US010483692B2

(12) United States Patent
Ogashira

(10) Patent No.: US 10,483,692 B2
(45) Date of Patent: Nov. 19, 2019

(54) LEVERY-TYPE CONNECTOR

(71) Applicant: Sumitomo Wiring Systems, Ltd., Yokkaichi, Mie (JP)

(72) Inventor: Daisuke Ogashira, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/083,537

(22) PCT Filed: Feb. 27, 2017

(86) PCT No.: PCT/JP2017/007291

§ 371 (c)(1),
(2) Date: Sep. 10, 2018

(87) PCT Pub. No.: WO2017/159304

PCT Pub. Date: Sep. 21, 2017

(65) Prior Publication Data

US 2019/0074633 A1 Mar. 7, 2019

(30) Foreign Application Priority Data

Mar. 18, 2016 (JP) ..... 2016-054907

(51) Int. Cl.
*H01R 13/62* (2006.01)
*H01R 13/629* (2006.01)

(52) U.S. Cl.
CPC . *H01R 13/62938* (2013.01); *H01R 13/62955* (2013.01)

(58) Field of Classification Search
CPC ..... H01R 13/62955; H01R 13/62938; H01R 13/193; H01R 13/502; H01R 13/639; H01R 13/648; H01R 13/629
(Continued)

(56) References Cited

U.S. PATENT DOCUMENTS 7,794,247 B2 * 9/2010 Suzuki ..... H01R 13/62955 439/157
8,202,116 B2 * 6/2012 Suzuki ..... H01R 13/648 439/607.01

(Continued)

FOREIGN PATENT DOCUMENTS

| | | |
|---|---|---|
| JP | 3573280 | 10/2004 |
| JP | 2009-70754 | 4/2009 |
| JP | 2013-246914 | 12/2013 |

OTHER PUBLICATIONS

International Search Report dated Apr. 25, 2017.

*Primary Examiner* — Jean F Duverne
(74) *Attorney, Agent, or Firm* — Gerald E. Hespos; Michael J. Porco; Matthew T. Hespos

(57) ABSTRACT

A lever-type connector includes a housing (10) having support shafts (27) projecting therefrom, and a lever (30) including bearings (33) to be supported on the housing (10) by receiving the support shafts (27), an operating portion (31) disposed to receive an applied force during a connecting operation, and cam grooves (36) to be engaged with cam followers (98) of a mating housing (90) and configured to assist connection of the housing (10) and the mating housing (90) by rotation about the bearings (33). Axial centers of the cam followers (98) engaged with the cam grooves (36) are displaced toward the operating portion (31) with respect to axial centers of the bearing portions (33) in a direction perpendicular to a connecting direction of the housing (10) and the mating housing (90).

5 Claims, 7 Drawing Sheets

(58) Field of Classification Search
USPC ..... 439/157
See application file for complete search history.

(56) References Cited

U.S. PATENT DOCUMENTS

| | | | | |
|---|---|---|---|---|
| 8,277,259 | B2 * | 10/2012 | Hattori | H01R 13/639 439/660 |
| 8,506,313 | B2 * | 8/2013 | Fukuda | H01R 13/639 439/262 |
| 8,517,753 | B2 * | 8/2013 | Kataoka | H01R 13/502 439/261 |
| 8,523,587 | B2 * | 9/2013 | Suzuki | H01R 13/193 439/262 |
| 8,784,127 | B2 * | 7/2014 | Bashkin | H01R 13/62955 439/372 |
| 2002/0025704 | A1 * | 2/2002 | Takata | H01R 13/62938 439/157 |
| 2003/0022539 | A1 * | 1/2003 | Takahashi | H01R 13/62938 439/157 |
| 2007/0184692 | A1 * | 8/2007 | Ohtaka | H01R 13/62955 439/157 |
| 2008/0102667 | A1 * | 5/2008 | Ikeya | H01R 13/62938 439/157 |
| 2009/0023316 | A1 * | 1/2009 | Takahashi | H01R 13/62938 439/157 |
| 2009/0075506 | A1 | 3/2009 | Suzuki | |

* cited by examiner

LEVERY-TYPE CONNECTOR

BACKGROUND

Field of the Invention

The invention relates to a lever-type connector.

Related Art

Japanese Patent No. 3573280 discloses a lever type connector with a female housing and a male housing that are connectable to each other and a lever to be mounted on the male housing. The lever has two arms extending from an operating portion to define a U-shape. Each arm portion includes a shaft hole to be supported on a shaft of the male housing and a cam groove opens on an edge on a side opposite to the operating portion across the shaft hole. Follower pins project on both side surfaces of the female housing. Rotation of the lever about the shafts that fit in the shaft holes causes the follower pins to move from starting parts to final parts of the cam grooves and enables the connection of the housings to proceed. Axial centers of the follower pins inserted into the cam grooves are arranged coaxially with those of the shaft holes in a connecting direction of the housings.

If the axial centers of the follower pins and those of the shaft holes are coaxially arranged in the connecting direction as described above, the final end parts of the cam grooves are set substantially at the same height as the shaft holes in a direction perpendicular to the connecting direction when the housings are connected properly. Thus, formation ranges of the cam grooves from the stating parts to the final parts easily shift toward a side opposite to the operating portion with respect to the shaft holes, and the lever tends to be enlarged in the direction perpendicular to the connecting direction. Further, the shaft holes and the follower pins need to be distanced in the connecting direction when the housings are connected properly, the lever may also be enlarged in the connecting direction.

The invention was completed on the basis of the above situation and aims to provide a lever-type connector capable of achieving miniaturization of a lever.

SUMMARY

A lever-type connector of the invention includes a housing having a support shaft projecting therefrom. A lever including a bearing is supported on the housing by receiving the support shaft. The lever has an operating portion serving as a point of application at the time of a connecting operation. The lever also has a cam groove to be engaged with a cam follower of a mating housing and configured to connect the housing and the mating housing by rotation about the bearing portion. An axial center of the cam follower engaged with the cam groove is displaced toward the operating portion with respect to an axial center of the bearing in a direction perpendicular to a connecting direction of the housing and the mating housing.

According to the above configuration, a final end part of the cam groove is located on the side of the operating portion with respect to the bearing in the direction perpendicular to the connecting direction when the housings are connected properly. Thus, an extending amount of the cam groove toward a side opposite to the operating portion with respect to the bearing can be suppressed, and the lever is not enlarged in the direction perpendicular to the connecting direction. Further, a distance between the bearing and the cam follower in the connecting direction when the housings are connected properly can be made shorter. Thus, the lever is not enlarged in the connecting direction.

A first side of the housing in the direction perpendicular to the connecting direction may define an area having a larger connection resistance to the mating housing than the second side, and the axial center of the cam follower engaged with the cam groove may be displaced toward the first side of the housing.

In the process of rotating the lever, the second side of the housing having a smaller connection resistance is pulled more easily toward the mating housing than the first side, and the housing may be connected to the mating housing in such an inclined state that the first side is lifted. In that respect, the axial center of the cam follower engaged with the cam groove is located on the first side of the housing. Therefore, a force acts to pull the first side of the housing toward the mating housing from the bearing toward the cam follower in the process of rotating the lever, and the first and the second sides of the housing can be connected to the mating housing in a well-balanced manner. As a result, the housings cannot be connected in an inclined state.

The lever includes a deflectable lever lock on the operating portion, and the housing includes a housing lock. The lever lock is locked resiliently to the housing lock when the connection of the housing and the mating housing is completed. The operating portion includes a protruding piece configured to cover the lever lock from the outside.

The lever lock is locked resiliently to the housing lock when the connection of the housings is completed. Thus, the lever is fixed to the housing and the housings are held in a connected state. A locking sound is generated when the lever lock is locked resiliently to the housing lock, and it can be known that the housings have been connected properly. However, if the lever is miniaturized, the lever lock is pressed by a finger, and a resilient force of the lever lock is reduced and the locking sound may become smaller. In that respect, the operating portion includes the protruding piece configured to cover the lever lock from outside according to the above configuration. Therefore, the lever lock is protected by the protruding piece and the lever lock is locked to the housing lock with a predetermined resilient force. As a result, a predetermined locking sound is generated and reliability in detecting the connection of the housings can be ensured.

The lever-type connector includes a wire cover configured to cover a wire pulled out from the housing, and the protruding piece is in contact with the wire cover when the connection of the housing and the mating housing is started. According to this configuration, the rotation of the lever toward the wire cover is restricted when the connection of the housings is started. Further, since the protruding piece has both a function of restricting the rotation of the lever and a function of protecting the lever lock, the configuration of the lever can be simplified.

DETAILED DESCRIPTION

Figure 1:
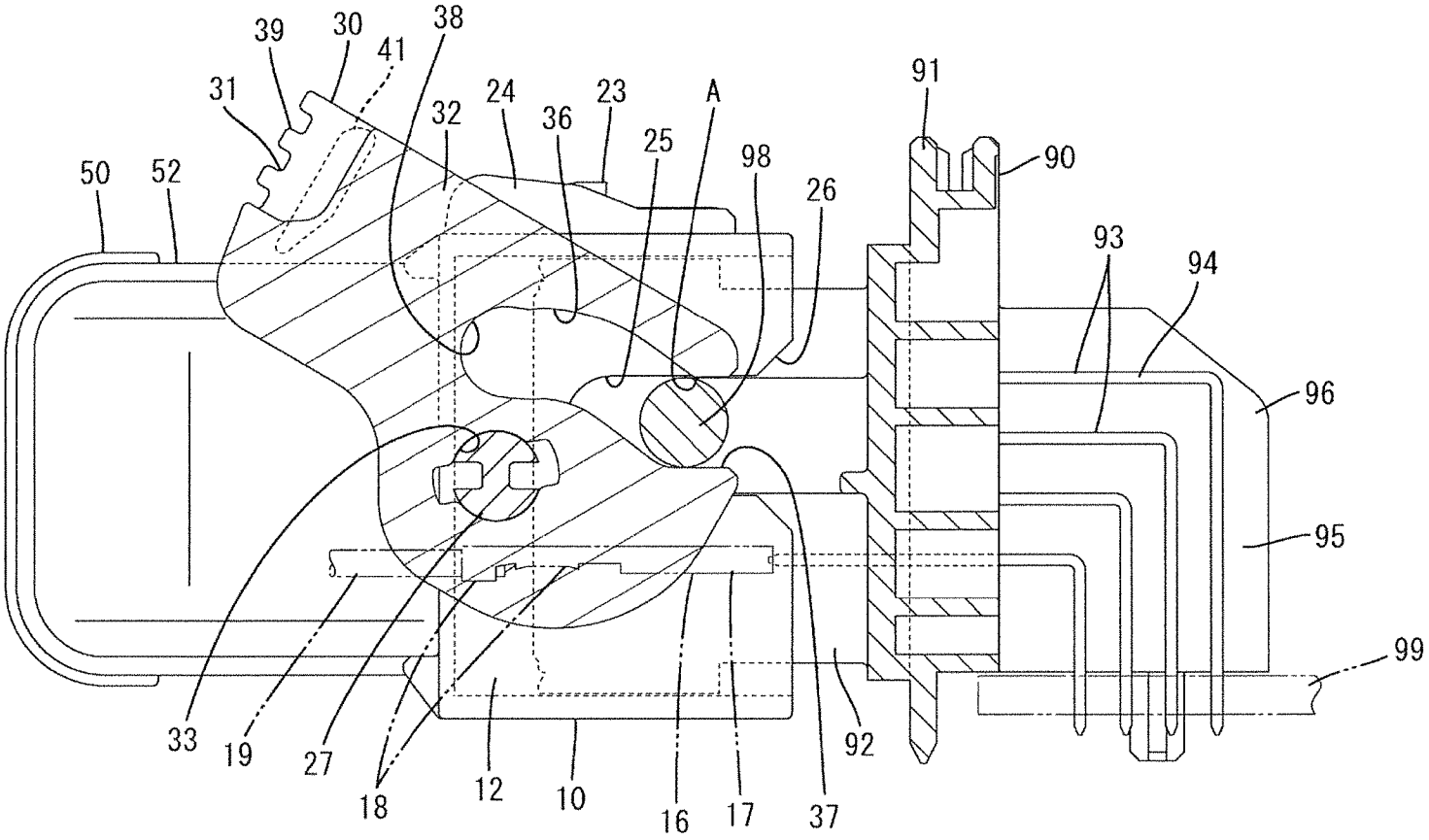
FIG. 1 is a partial section showing a state where a lever is at a partial locking position and a housing is connected lightly to a mating housing in a lever-type connector according to one embodiment of the invention.

One embodiment of the invention is described with reference to FIGS. 1 to 8. A lever-type connector of this embodiment includes a housing 10, a lever 30 and a wire cover 50. The housing 10 is connectable to a mating housing 90. Note that, in the following description, surfaces of the housings 10, 90 facing each other at the start of connection are referred to as fronts concerning a front-rear direction and a vertical direction is based on each figure except FIG. 4. Further, a lateral direction is based on FIGS. 3 and 7.

Figure 7:
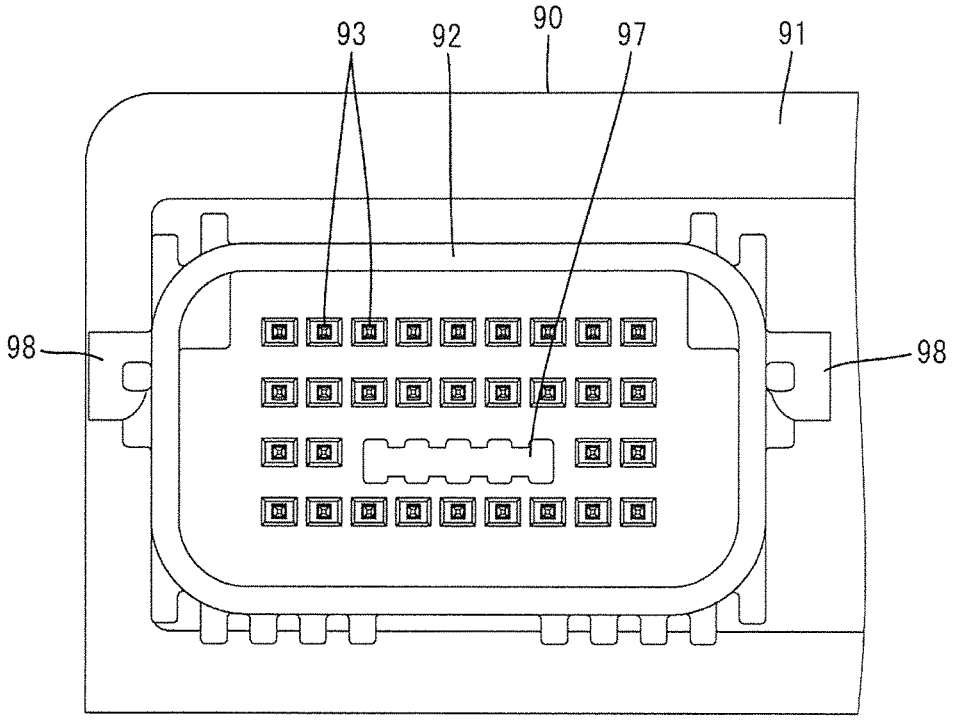
FIG. 7 is a front view of the mating housing.
Figure 8:
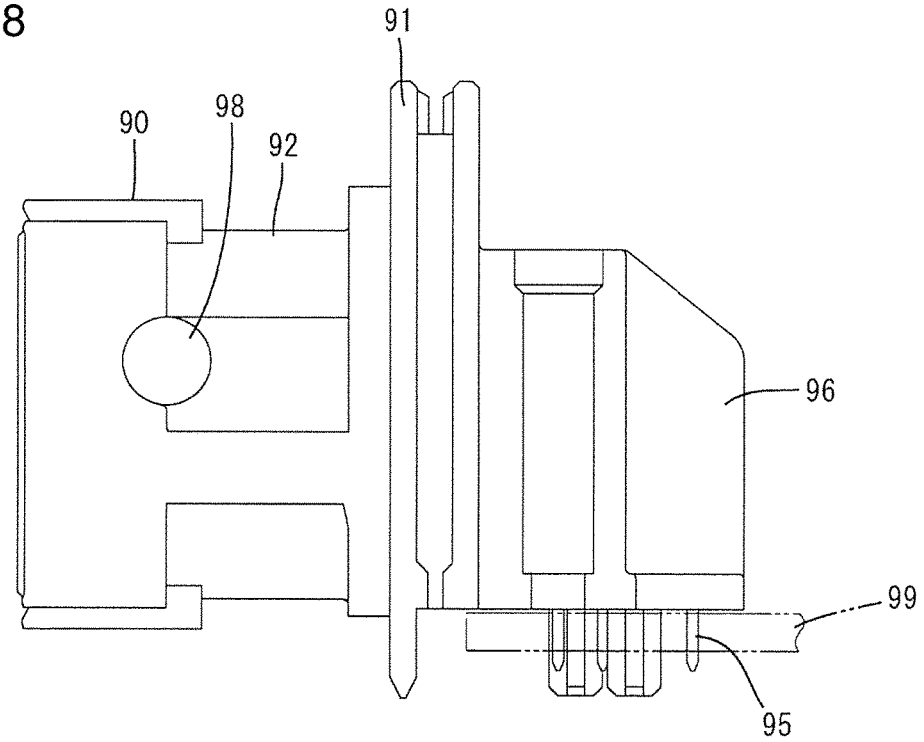
FIG. 8 is a side view of the mating housing.

The mating housing 90 is made of synthetic resin and includes, as shown in FIGS. 7 and 8, a plate-like back wall 91 extending along the vertical direction and the lateral direction and a receptacle 92 substantially in the form of a rectangular tube projecting forward from the back wall 91. Mating terminal fittings 93 project into the receptacle 92. As shown in FIG. 1, each mating terminal fitting 93 is in the form of a pin L-shaped in a side view and includes a horizontal portion 94 projecting into the receptacle 92 and connectable to a terminal fitting 16 to be described later, and a vertical portion 95 to be soldered and connected to a printed circuit board 99. The vertical portions 95 of the respective mating terminal fittings 93 are covered on both sides by side walls 96 protruding rearward from the back wall 91.

As shown in FIG. 7, a projecting piece 97 projects in a laterally central part of a lower part in the receptacle 92. The projecting piece 97 is a plate projecting forward from the front surface of the back wall 91 and has a flat cross-sectional shape extending in the lateral direction.

Two cam followers 98 project on outer surfaces of both left and right side walls of the receptacle 92. Each cam follower 98 is a projection in the form of a cylindrical column and, as shown in FIG. 8, is arranged at a position near the front end of the side wall of the receptacle 92 and above a vertical center of the receptacle 92.

Figure 3:
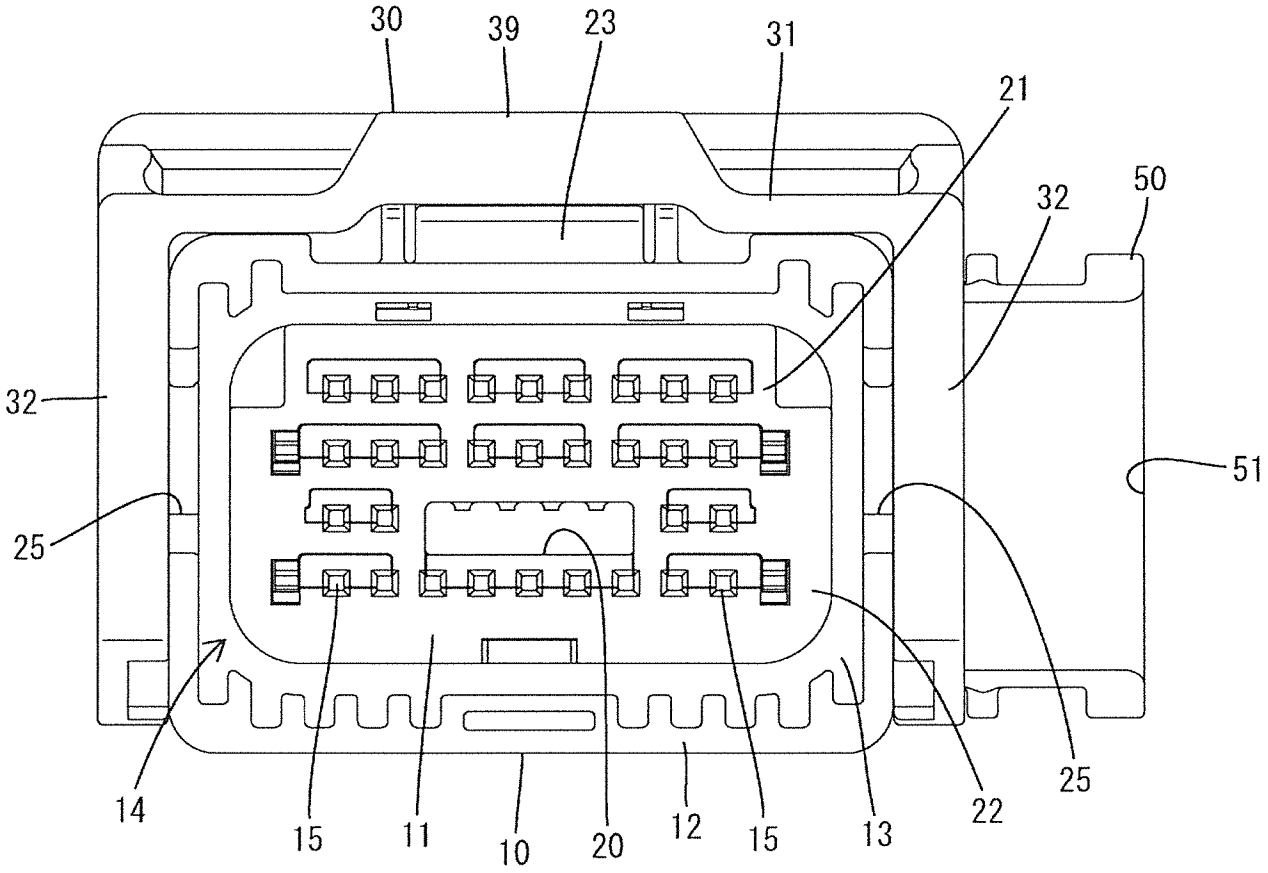
FIG. 3 is a front view when the lever is at the full locking position.

The housing 10 is made of synthetic resin and includes, as shown in FIG. 3, a housing body 11 substantially in the form of a rectangular block, a substantially rectangular fitting tube 12 surrounding the outer periphery of the housing body 11 and a coupling 13 extending in a radial direction to couple the fitting tube 12 and the housing body 11. A forwardly open space between the fitting tube 12 and the housing body 11 and open forward of the coupling 13 serves as a connection space 14 into which the receptacle 92 of the mating housing 90 is finable.

The housing body 11 includes cavities 15 at positions corresponding to the respective mating terminal fittings 93. The terminal fittings 16 are inserted into each cavity 15 from behind. As shown in FIG. 1, each terminal fitting 16 includes a tubular connecting portion 17 into which the mating terminal fitting 93 is inserted for connection and a barrel 18 behind the connecting portion 17 for connection to an end part of a wire 19. When the terminal fitting 16 is inserted into the cavity 15, the wire 19 connected to the terminal fitting 16 is pulled out from the rear surface of the housing body 11 and a pulled-out part is accommodated in the wire cover 50.

As shown in FIG. 3, a recess 20 in the form of a laterally long slit is open in the front surface in a laterally central part of a lower part of the housing body 11. When the housings 10, 90 are in proper connection postures, the projecting piece 97 of the mating housing 90 is inserted into the recess 20 and a connecting operation of the housings 10, 90 proceeds. On the other hand, if the housings 10, 90 are in postures inclined from the proper postures or in vertically inverted postures, the projecting piece 97 of the mating housing 90 interferes with the front surface of the housing body 11 so that the connecting operation of the housings 10, 90 is stopped. In this way, forcible connection or erroneous connection of the housings 10, 90 can be prevented.

There are fewer cavities 15 in the lower part of the housing body 11 than in an upper part due to the presence of the recess 20. Because of this, more terminal fittings 16 are inserted into the cavities 15 in the upper part of the housing body 11 than in the lower part. A connecting operation of the terminal fittings 16, 93 proceeds in the process of connecting the housings 10, 90. As a result, the upper part of the housing body 11 becomes a high resistance part 21 having a large connection resistance, and the lower part of the housing body 11 becomes a low resistance part 22 having a small connection resistance.

Figure 4:
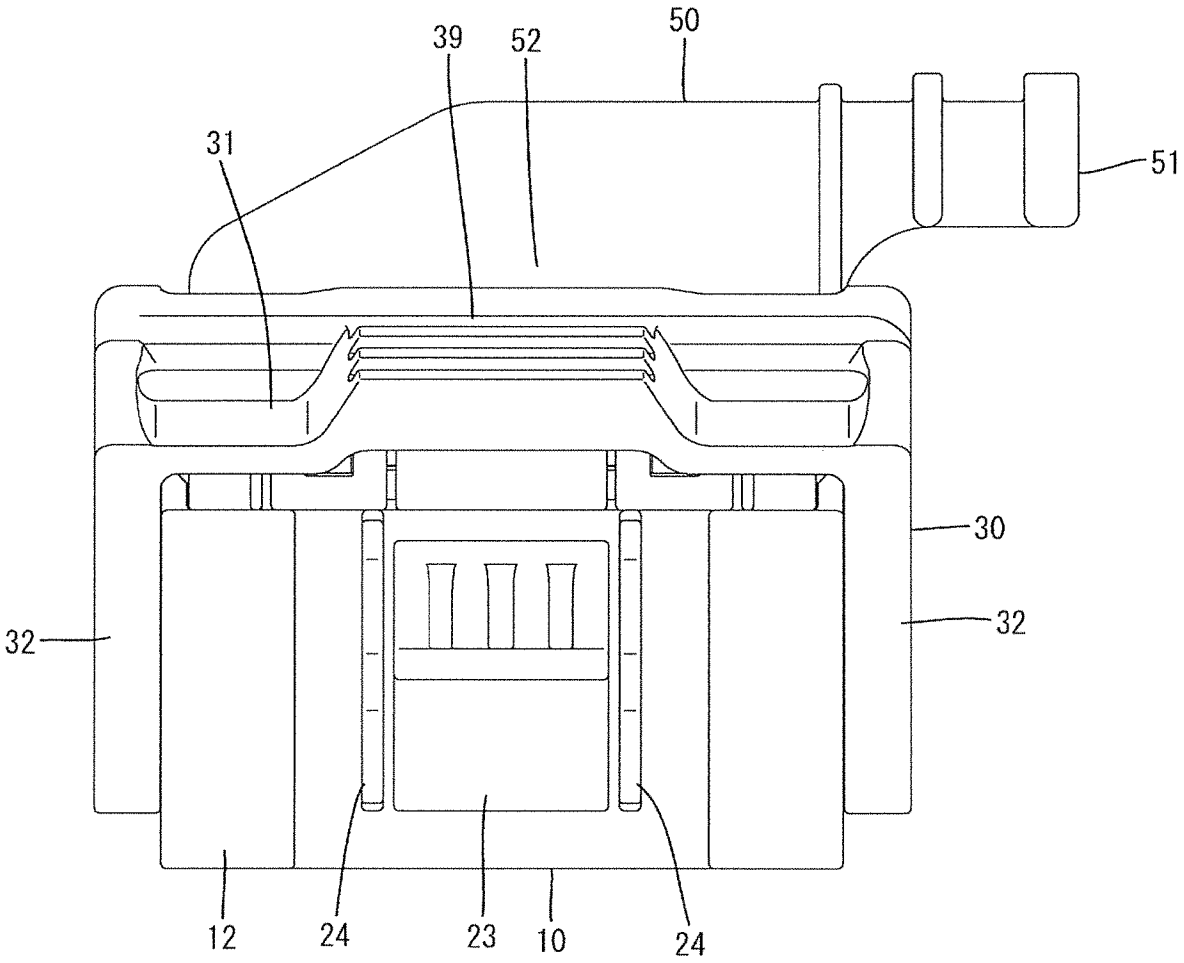
FIG. 4 is a plan view when the lever is at the partial locking position.

A housing lock 23 projects in a laterally central part of the outer surface (upper surface) of an upper wall of the fitting tube 12. As shown in FIG. 4, the housing lock 23 has a rectangular shape in a plan view and is arranged between guide walls 24 on both left and right sides.

Two forwardly open introducing grooves 25 extend in the front-rear direction and penetrate through both left and right side walls of the fitting tube 12. As shown in FIG. 1, the introducing groove 25 includes a front end expanding portion 26 expanded toward the front end of the side wall of the fitting tube 12. In the process of connecting the housings 10, 90, the cam followers 98 are inserted to back sides of the introducing grooves 25 through the front end expanding portions 26. Note that base end parts of the cam followers 98 are inserted into the introducing grooves 25 and tip parts thereof are inserted into later-described cam grooves 36 of the lever 30 in the process of connecting the housings 10, 90.

Figure 6:
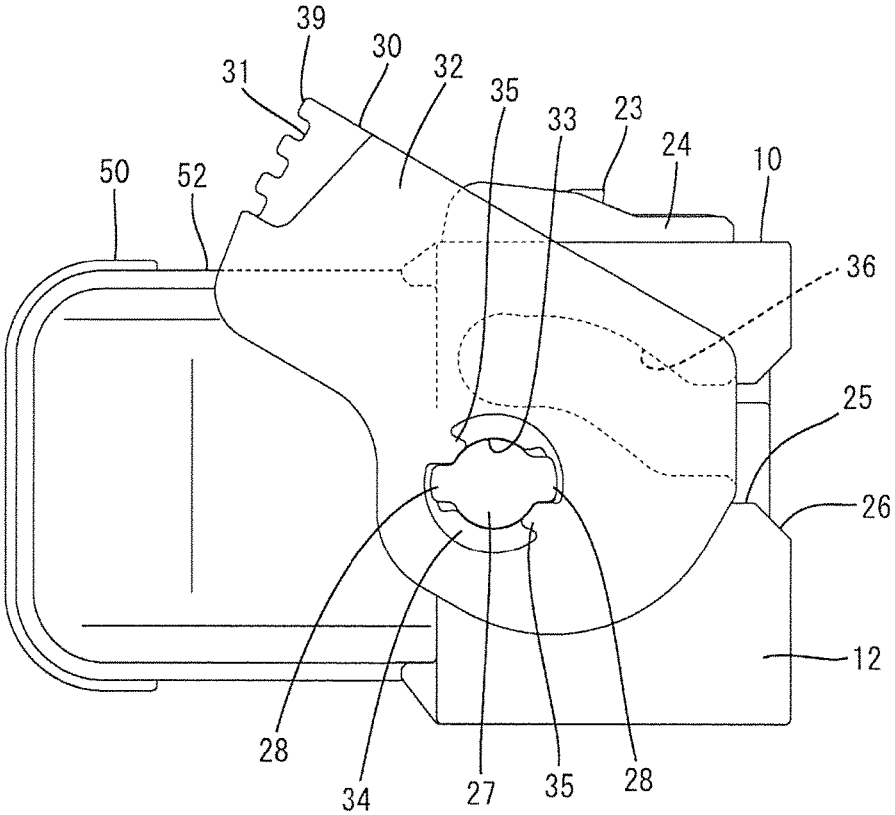
FIG. 6 is a side view when the lever is at the partial locking position.

Support shafts 27 project behind the introducing grooves 25 on both left and right side walls of the fitting tube 12. The support shaft 27 has a substantially cylindrical shape and includes, as shown in FIG. 6, retaining pieces 28 protruding toward both front and rear sides on a tip part. An axial center of the support shaft 27 is arranged in a rear part of the fitting tube 12 and below a vertical center of the fitting tube 12. Note that a vertical center of the introducing groove 25 is arranged above that of the fitting tube 12.

Figure 5:
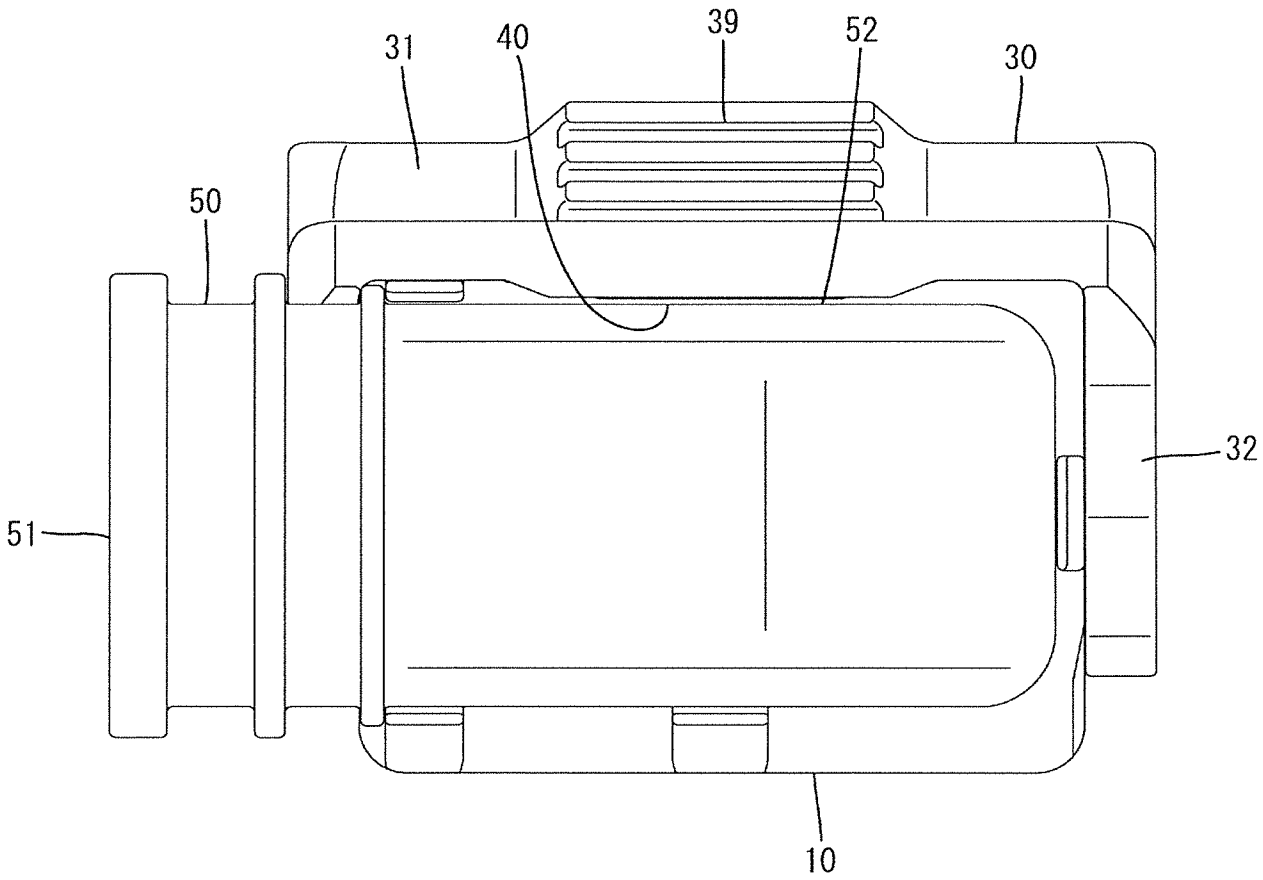
FIG. 5 is a back view when the lever is at the partial locking position.

The wire cover 50 is made of synthetic resin and, as shown in FIGS. 3 to 6, cap-shaped as a whole. This wire cover 50 is mounted on the housing body 11 to cover the rear surface of the housing body 11, and the wires 19 pulled out from the rear surface of the housing body 11 are accommodated inside the wire cover 50. The wires 19 are bent inside the wire cover 50 and pulled out to outside through a draw-out opening 51 on one lateral side perpendicular to the front-rear direction. A part of the wire cover 50 including the draw-out opening 51 projects toward one lateral side of the housing 10 in a front view. As shown in FIG. 5, an upper wall of the wire cover 50 has a flat outer surface 52 extending along the lateral direction, and the lever 30 can be in contact with and supported by the flat surface 52 at a partial locking position to be described later.

Figure 2:
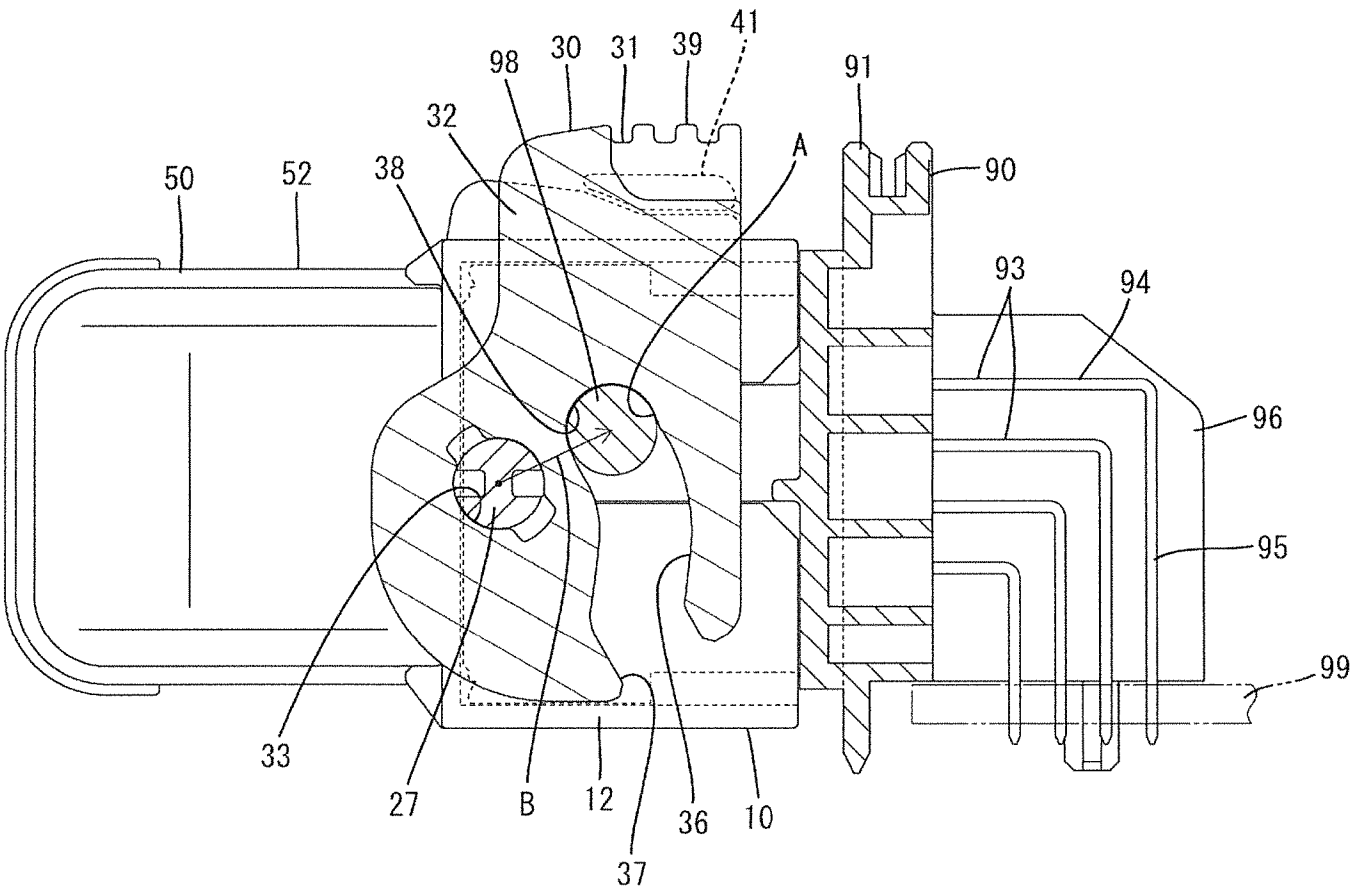
FIG. 2 is a partial section showing a state where a lever is at a full locking position and the housing is connected properly to the mating housing.

The lever 30 is made of synthetic resin, includes an operating portion 31 extending in the lateral direction and two cam portions 32 projecting parallel to each other from both left and right ends of the operating portion 31, as shown in FIGS. 2 and 3, to define a U-shape as a whole. An extending amount of the operating portion 31 in the lateral direction is larger than a downward projecting amount of cam portions 32.

The lever 30 is assembled from above to straddle the housing 10, and the both cam plates 32 are arranged to face the outer surfaces of the both left and right side walls of the fitting tube portion 12. A substantially circular bearing 33 is provided to penetrate through each cam plate 32. The lever 30 is rotatably supported on the housing 10 by fitting the support shafts 27 into the bearings 33. With respect to the housing 10, the lever 30 can be held at the partial locking position (see FIGS. 1 and 4 to 6) where the operating portion 31 is separated rearward from the fitting tube 12 and a full locking position (see FIGS. 2 and 3) where the operating portion 31 is arranged right above the fitting tube 12.

As shown in FIG. 2, axial centers of the bearings 33 (also axial centers of the support shafts 27) are arranged below vertical centers of the cam plates 32 and behind lateral centers of the cam plates 32 and at the same position as or behind the rear end of the operating portion 31 in the front-rear direction when the lever 30 is at the full locking position.

As shown in FIG. 6, recesses 34 for allowing the retaining pieces 28 of the support shaft 27 to escape in the process of rotating the lever 30 are provided circumferentially on opening edges of the respective bearings 33 on the outer surface of the cam plates 32. Each recess 34 is divided in a circumferential direction by stoppers 35 facing each other in a radial direction. A rotation stroke of the lever 30 is specified within a range where the retaining pieces 28 are displaced in the recess 34 between the stoppers 35.

Further, each cam plate 32 is provided with the cam groove 36 extending in a state curved in a predetermined direction and open on an outer edge. Each cam groove 36 is a bottomed groove open in the inner surface (surface facing the other cam plate 32) of the cam plate 32 and closed on the outer surface of the cam plate 32. As shown in FIG. 2, the cam groove 36 is arranged such that a starting part 37 (entrance) is open on a lower edge opposite to the operating portion across the bearing 33 and a final part 38 is arranged above and before an axial center of the bearing 33. Each cam groove 36 communicates with the introducing groove 25 and is engageable with a tip of the cam follower 98 via the introducing groove 25.

As shown in FIGS. 1 and 2, an engaging position A of a groove edge of the cam groove 36 where the cam follower 98 slides is set to be above and before the axial center of the bearing 33. In the case of this embodiment, in the process of rotating the lever 30 from the partial locking position to the full locking position in the connecting process of the housings 10, 90, the cam followers 98 slide on front edges of the cam grooves 36 as shown, so that the connecting operation of the housings 10, 90 proceeds.

An anti-slip portion 39 is provided in a laterally central part of the operating portion 31. The anti-slip portion 39 is composed of streaky projections and recesses extending in the lateral direction at a position slightly higher than both left and right sides. Further, as shown in FIG. 5, a protruding piece 40 protrudes rearward from the anti-slip portion 39 in a laterally central part of the operating portion 31. Furthermore, a deflectable lever lock 41 is provided inside the anti-slip portion 39 and the protruding piece 40 in the laterally central part of the operating portion 31 (see FIGS. 1 and 2). The lever lock 41 is structured similarly to known resilient lock pieces although not shown in detail, and has an outer side covered by the anti-slip portion 39 and the protruding piece 40.

If the lever 30 reaches the full locking position when the housings 10, 90 are connected properly, the lever lock 41 is locked resiliently to the housing lock 23, thereby restricting the rotation of the lever 30 and holding the housings 10, 90 in a connected state. Note that the protruding piece 40 covers a locking part of the lever lock 41 so that a worker's hand does not touch the locking part of the lever lock 41.

Next, the connecting operation and functions of the lever-type connector of this embodiment are described.

Prior to the start of the connecting operation of the housings 10, 90, the lever 30 is kept at the partial locking position with respect to the housing 10. At the partial locking position, the protruding piece 40 of the operating portion 31 is in contact with the flat surface 52 of the wire cover 50 (see FIG. 5) and the retaining pieces 28 are in contact with the stoppers 35 (see FIG. 6), thereby restricting the rotation of the lever 30 in a direction opposite to a direction from the partial locking position to the full locking position. Further, at the partial locking position, the starting parts 37 of the cam grooves 36 communicate with the introducing grooves 25 and are arranged to face forward, as shown in FIG. 1.

The housing 10 is connected lightly to the mating housing 90 with the lever 30 held at the partial locking position. When the receptacle 92 is fit into the connection space 14 of the housing 10, the cam followers 98 are inserted over the introducing grooves 25 and the starting parts 37 of the cam grooves 36 (see FIG. 1). Subsequently, the lever 30 is rotated toward the full locking position by gripping the operating portion 31. At this time, the worker's hand touches the anti-slip portion 39 and, in some cases, also touches the protruding piece 40, but does not touch the locking part of the lever lock portion 41 since the locking part is covered by the protruding piece 40.

Further, in the process of moving the lever 30 toward the full locking position, the cam followers 98 slide on the groove edges of the cam grooves 36 to exhibit a cam action between the lever 30 and the mating housing 90. As a result, the connecting operation of the housings 10, 90 proceeds with a low connecting force. Here, the axial centers of the bearings 33 (axial centers of the support shafts 27) are located obliquely below and behind those of the cam followers 98 inserted into the cam grooves 36. Thus, if the cam action is exhibited, an operation force acts on the housing body 11 obliquely from the support shafts 27 toward the cam followers 98, i.e. toward an upper-front side of FIG. 2 (see an arrow B). On the other hand, the low resistance portion 22 of the housing body 11 has a smaller connection resistance than the high resistance portion 21. Thus, a connection force also acts on the housing body 11 to pull the lower part on the side of the low resistance portion 22 toward the mating housing 90 earlier than the upper part on the side of the high resistance portion 21. In this way, the operation force and the connection force act on the housing body 11 substantially in mutually opposite directions to be canceled, and a connection balance of the housings 10, 90 is kept.

When the lever 30 reaches the full locking position, the cam followers 98 reach the final parts 38 of the cam grooves 36, the housings 10, 90 are connected properly and the lever lock 41 is locked to the housing lock 23 to hold the lever 30 in a rotation restricted state, as shown in FIG. 2. Note that the final parts 38 of the cam grooves 36 are kept located above and before the axial centers of the bearings 33 in the entire process of rotating the lever 30.

Further, at the full locking position, the resiliently returning lever lock 41 hits a facing wall surface of the housing 10 to generate a locking sound. Thus, by hearing the locking sound, it can be known that the lever 30 has reached the full locking position and the housings 10, 90 have been connected properly. In this case, the locking part of the lever lock 41 is protected by the protruding piece 40 and is not touched by the worker's hand in the process of rotating the lever 30. Thus, the lever lock 41 can generate a predetermined locking sound by being satisfactorily deflected.

The axial centers of the cam followers 98 engaged with the cam grooves 36 are displaced up toward the operating portion 31 with respect to the axial centers of the bearings 33 in the vertical direction (direction perpendicular to the connecting direction of the housing 10 and the mating housing 90). Thus, when the housings 10, 90 are connected properly, the final end parts 38 of the cam grooves 36 accommodating the cam followers 98 are displaced toward the operating portion 31 with respect to the bearings 33. Thus, the extending amount of the cam grooves 36 toward the side (lower side) opposite to the operating portion 31 with respect to the bearings 33 can be suppressed to be small as compared to the case where the final end parts 38 are located at the same height as the bearing portions 33. Therefore, the lever 30 is not enlarged in the vertical direction.

The axial centers of the cam followers 98 engaged with the cam grooves 36 are displaced up toward the operating portion 31 with respect to the axial centers of the bearings 33 in the vertical direction. Therefore, a distance between the bearings 33 and the cam followers 98 in the front-rear direction (connecting direction) when the housings 10, 90 are connected properly can be made shorter. Thus, the lever 30 is not enlarged in the front-rear direction, and the lever 30 can be miniaturized.

The axial centers of the cam followers 98 engaged with the cam grooves 36 are displaced toward the high resistance portion 21 of the housing body 11. Accordingly, the operation force and the connection force acting on the housing body are balanced to prevent the housings 10, 90 from being connected in an inclined state.

The operating portion 31 includes the protruding piece 41 for covering the lever lock 41 from outside. Thus, the worker cannot touch the lever lock 41 in the process of rotating the lever 30, and a predetermined locking sound can be generated when the lever lock 41 is locked resiliently to the housing lock 23. As a result, reliability in detecting the connection of the housings 10, 90 can be ensured.

Furthermore, when the lever 30 is at the partial locking position, the rotation of the lever 30 toward the wire cover 50 is restricted since the protruding piece 40 is in contact with the flat surface 52 of the wire cover 50. In this case, the protruding piece 40 has both a function of restricting the rotation of the lever 30 and a function of protecting the lever lock 41. Therefore, the configuration of the lever 30 can be simplified, which can contribute to the miniaturization of the lever 30.

Other embodiments are briefly described below.

The lever may be constituted by a cam plate in the form of a single plate as a whole.

Contrary to the above embodiment, the high resistance portion may be provided in the lower part of the housing body and the low resistance portion may be provided in the upper part of the housing body. Further, the high resistance portion and the low resistance portion may be separately provided on both left and right sides of the housing body.

A resistance difference between the high resistance portion and the low resistance portion is not only caused by a difference in the number of the terminal fittings as in the above embodiment, but also caused by another factor for generating sliding resistance such as a guiding structure or a sealing structure.

LIST OF REFERENCE SIGNS

10 . . . housing
19 . . . wire
21 . . . high resistance portion
22 . . . low resistance portion
23 . . . housing lock
30 . . . lever
31 . . . operating portion
32 . . . cam plate
33 . . . bearing
36 . . . cam groove
40 . . . protruding piece
41 . . . lever lock
50 . . . wire cover
90 . . . mating housing
98 . . . cam follower

The invention claimed is:

1. A lever-type connector, comprising:

a housing having a support shaft projecting therefrom; and a lever including a bearing to be supported on the housing by receiving the support shaft, an operating portion disposed to receive an applied force during a connecting operation, and a cam groove to be engaged with a cam follower of a mating housing and configured to assist connection of the housing and the mating housing by rotation about the bearing, wherein:

an axial center of the cam follower engaged with the cam groove is offset toward the operating portion with respect to an axial center of the bearing in a direction perpendicular to a connecting direction of the housing and the mating housing;

the operating portion of the lever moves toward the mating housing as the lever is rotated from a partial locking position to a full locking position, and the housing and the mating housing are connected properly at the full locking position; and the cam groove extends from a starting part where the cam groove is open on an outer peripheral edge of a cam portion of the lever to a final part, the final part of the cam groove and the operating portion of the lever being located on a same side of the lever with respect to the axial center of the bearing at least when the lever is at the partial locking position.

2. The lever-type connector of claim 1, wherein a first side of the housing in the direction perpendicular to the connecting direction is configured to have a larger connection resistance to the mating housing than a second side, and the axial center of the cam follower engaged with the cam groove is offset toward the first side of the housing.

3. The lever-type connector of claim 1, wherein the lever includes a deflectable lever lock on the operating portion, the housing includes a housing lock, the lever lock is locked to the housing lock when the connection of the housing and the mating housing is completed, and the operating portion includes a protruding piece configured to cover the lever lock from outside.

4. The lever-type connector of claim 3, comprising a wire cover configured to cover a wire pulled out from the housing, wherein the protruding piece is in contact with the wire cover when the connection of the housing and the mating housing is started.

5. The lever-type connector of claim 1, wherein the final part of the cam groove and the operating portion of the lever being located on a same side of the lever with respect to the axial center of the bearing when the lever is at the final locking position.

* * * * *